United States Patent [19]

Tsushima et al.

[11] Patent Number: 4,718,783

[45] Date of Patent: Jan. 12, 1988

[54] THERMAL PRINTER

[75] Inventors: Mitsuo Tsushima, Iwate; Hiroshi Abe, Iwaki, both of Japan

[73] Assignee: Alps Electric Co., Ltd., Japan

[21] Appl. No.: 943,384

[22] Filed: Dec. 17, 1986

[30] Foreign Application Priority Data

Jan. 30, 1986 [JP] Japan ..... 61-10946
Jan. 30, 1986 [JP] Japan ..... 61-10948

[51] Int. Cl.[4] ..... B41J 11/08

[52] U.S. Cl. ..... 400/23; 400/578; 400/642; 400/208; 400/211

[58] Field of Search ..... 400/23, 29, 211, 212, 400/224, 229, 36, 595, 600.2, 600.4, 624, 208; 235/58 CW, 58 CF, 58 P, 101

[56] References Cited

U.S. PATENT DOCUMENTS

| | | | |
|---|---|---|---|
| 3,334,722 | 8/1967 | Bernard | 400/613.2 X |
| 3,828,664 | 8/1974 | Dikoff | 400/23 X |
| 4,433,925 | 2/1984 | Fujiwara et al. | 400/88 |
| 4,605,145 | 8/1986 | Engelhardt et al. | 226/74 |
| 4,609,295 | 9/1986 | Shimodaira | 400/624 |
| 4,636,097 | 1/1987 | Goubeaux | 400/208 |

FOREIGN PATENT DOCUMENTS

| | | | |
|---|---|---|---|
| 3211451 | 10/1982 | Fed. Rep. of Germany | 400/29 |
| 0010472 | 2/1981 | Japan | 400/88 |

*Primary Examiner*—Edgar S. Burr
*Assistant Examiner*—Joseph McCarthy
*Attorney, Agent, or Firm*—Guy W. Shoup

[57] ABSTRACT

A printer characterized in that a paper feed path for guiding a record paper to a printing position formed between a platen and a head is disposed on the same plane on the whole including the printing position and portions before and behind the printing position.

3 Claims, 4 Drawing Figures

THERMAL PRINTER

This application is related to copending application Ser. No. 943,383 of the same inventors.

BACKGROUND OF THE INVENTION

1. Field of the Invention

The present invention relates to printers, and more particularly to a printer which can be formed into a thin type of apparatus.

2. Description of the Prior Art

FIG. 4 is a side view showing one example of a conventional printer used for personal computers, personal word processors, etc.

A feed roller 3 for transporting a paper 2 while being placed in contact with about one half of an outer peripheral surface thereof is rotatably disposed on the end of a paper guide 1 having a feed surface. A pressing roller 4 for pressing the paper 2 against the surface of the roller 3 is disposed under the roller 3. The pressing roller 4 is retained by a circular holding member 5, which is in turn secured to the bottom of the guide 1 by means of a pressing spring 6. A platen 7 for contacting a back surface of the paper 2 is disposed adjacent the paper outlet of the roller 3, and a head 8 is disposed opposite the plates 7. The head 8 is secured to a head mounting base 10 which rotates around a support point 9, and these elements are provided for parallel movement and secured to a carriage 11.

With the arrangement as described above, the head mounting base 10 and the carriage 11 are first rotated clockwise to form a clearance between the platen 7 and the head 8. Then the paper 2 is inserted between the paper guide 1 and the feed roller 3, and the roller 3 is rotated counterclockwise. Thereby the paper 2 is pressed against the surface of the roller 3 by the pressing roller 4 and rotates along with the roller 4 till it moves frontwardly of the head 8. The paper 2 is further moved and the end thereof is allowed to pass between the platen 7 and the head so that a predetermined length of the paper is exposed above the platen 7. Thereafter, the head mounting base 10 and the carriage 11 are rotated counterclockwise to bring the head 8 into pressure contact with the paper 2. In the case of the thermal transfer type, a ribbon is interposed between the head 8 and the paper 2. Under the condition as described above, a thermal resisting member of the head 8 is driven according to printing information, whereby the paper 2 is generated in color (in the case of thermal recording paper) or ink of the ribbon is transferred onto the paper 2 for printing. A head 24 is moved by the carriage 11 widthwise of the paper during printing.

In the conventional printer, since the platen and the head are arranged within the vertical plane, the apparatus is difficult to be formed into a thin type. Moreover, a piece of paper is printed in a state where the former is folded back through a transporting path having a curved surface, and therefore the following inconveniences result:

(a) The paper may develop a bend and become jammed in the printer.

(b) Feed resistance due to the bend results, and a great feed force is required and accordingly, a large feed device need be provided.

(c) When a paper is inserted, it has to be turned over, and therefore the operation becomes troublesome.

SUMMARY OF THE INVENTION

The present invention has been achieved in view of the foregoing. An object of the invention is to provide a printer which enables the apparatus to be made thin and which can print a print paper without turning it over.

For achieving the aforesaid object, the present invention provides a printer provided with a platen and a head which form a printing position and a paper feed path for guiding a record paper to said printing position, characterized in that said feed path is disposed on the same plane as the whole including said printing position and portions before and behind said printing position, and holding means is provided for holding the head substantially parallel to said feed path during printing.

According to the arrangement of the present invention, the printing head is disposed horizontally coplanar with a horizontal feed path opposite to the platen for printing. The paper feed roller is also disposed parallel to the horizontal feed path, and the ink ribbon cassette is disposed horizontally and includes means for drawing out and turning the ribbon so that it is horizontally disposed in front of the platen.

DESCRIPTION OF THE PREFERRED EMBODIMENTS

Figure 1:
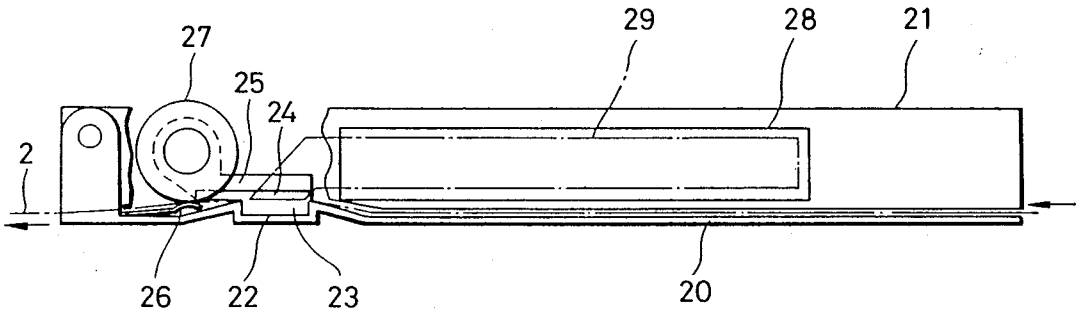
FIG. 1 is a side view showing an embodiment of a printer according to the present invention.
Figure 2:
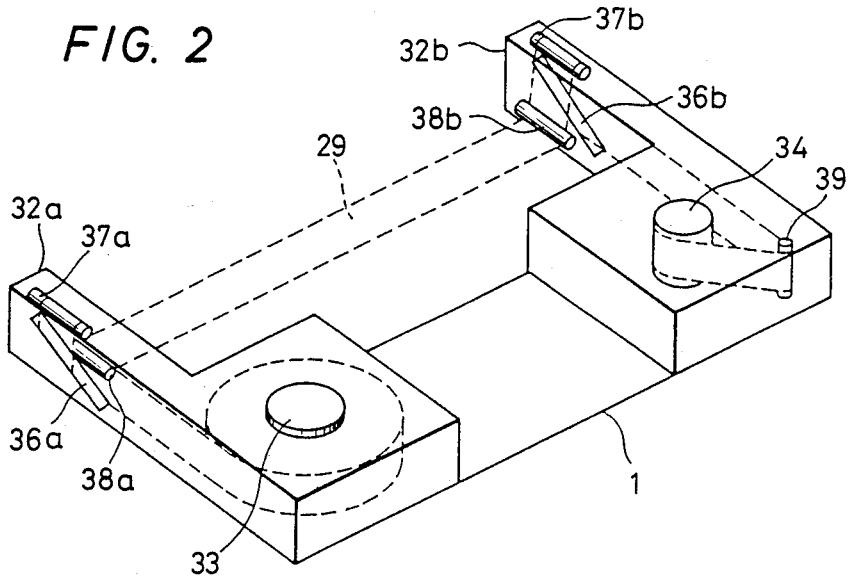
FIG. 2 is a side view showing one example of a ribbon cassette used in the printer according to the present invention.
Figure 3:
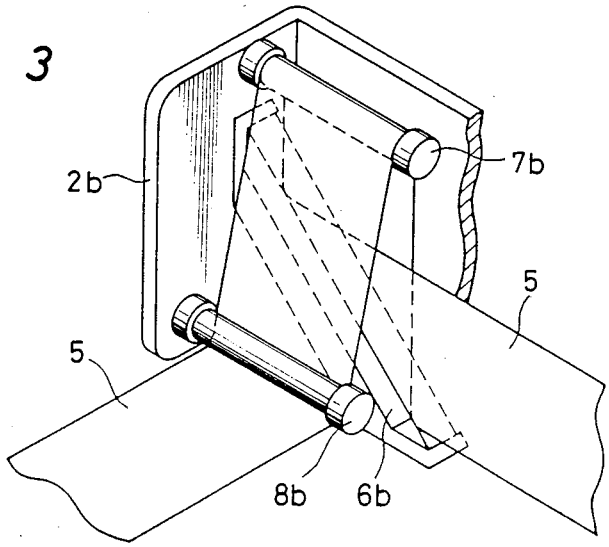
FIG. 3 is a perspective view showing the details of an ink ribbon holding portion in FIG. 2.
Figure 4:
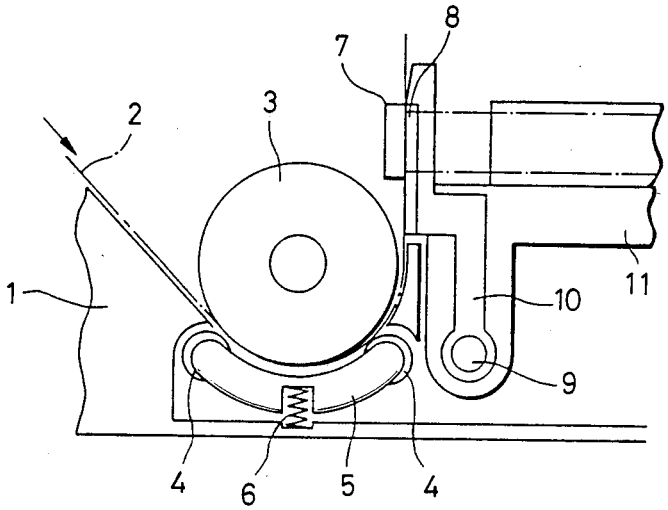
FIG. 4 PRIOR ART
FIG. 4 is a side view showing one example of a conventional printer.

Referring now to FIG. 1 which shows one embodiment of the present invention, a paper guide 20 in the form of a flat plate is horizontally disposed under a body 21 (which houses therein a ribbon cassette 28, a ribbon winding driving portion, a carriage driving portion, etc.). The guide 20 is formed at a predetermined position with a recess 22 at right angles to the moving direction of the record paper 2, and a platen 23 is disposed within the recess 22. A head 24 is disposed opposite the platen 23 and is secured to a carriage 25 rotatably disposed. A paper compression spring 26 for applying an upward resilient pressure on the paper against the feed roller 27 is disposed near the paper outlet side adjacent the recess 22, and a paper feed roller 27 is disposed parallel to the platen 23 so that the outer peripheral surface of the roller 27 may contact with the spring 26. A ribbon cassette 28 is detachably set within the body 21, and an ink ribbon 29 drawn out of the ribbon cassette 28 is horizontally disposed along the platen 23. A mechanism for shifting the ink ribbon 29 from a vertical state to a horizontal state is provided within the ribbon cassette as shown in FIGS. 2 and 3. FIG. 2 is a perspective view of the ribbon cassette, and FIG. 3 is a perspective view showing the details of a ribbon turn-back portion. Guide portions **32*a* and 32*b* receiving therein a plurality of ribbon guide rollers are projected on opposite ends of a case 31 having left and right box-shaped spaces. One of said box-shaped spaces is provided with a supply-spool 3 for rotatably winding an unused ink ribbon whereas the other is provided with a spool 34** for winding the used ink ribbon. The winding spool after having been loaded in the printer is wound during printing by the driving mechanism provided on the printer.

On the guide portion 32*a* are provided an inclined guide roller 36*a* for bending the ink ribbon 29 drawn out of the supply-spool 33 in the vertical direction, a guide roller 37*a* for turning the ink ribbon 29 from the guide roller 36 through about 180 degrees and a guide roller 38*a* for horizontally bending the ink ribbon 29 from the roller 37*a* toward the printing position.

Likewise, the guide portion 32*b* is provided with a guide roller 38*b* for vertically bending the ink ribbon 29 from the guide roller 39, a guide roller 37*b* for reversing through about 180 degrees the ink ribbon 29 from the roller 38*b*, and an inclined guide roller 36*b* for bending the ink ribbon 29 from the roller 37*b* into its upright horizontal position. The guide rollers 38*a* and 38*b* have a function to determine a height of an ink ribbon disposed in a printing area. A reference numeral 39 designates a guide roller for relaying the ink ribbon 29 from the inclined guide roller 36*b* to the winding spool 34.

With the arrangement as described above, the ink ribbon 29 is drawn out of the supply-spool 33 and upwardly bended by the inclined guide roller 36*a*, after which the ribbon 29 is reversved by the guide roller 37*a* and turned downwardly. Then the ribbon 29 is turned to the horizontal direction by the guide roller 38*a* and is drawn toward the guide portion 32*b* with the ink surface turned. The ink ribbon 29 from the guide roller 38*a* is turned by the guide roller 38*b* from the horizontal position to the vertical position. The upwardly directed ink ribbon 29 is turned downwardly through about 180 degrees by the guide roller 37*b*. Then the ink ribbon 29 is returned to the upright state where its width is vertical by the inclined guide roller 36*b*, and wound around the winding spool 34 through the guide roller 39.

While the printing position formed by the platen 23 and head 24 is present between the guide rollers 38*a* and 38*b*, it is noted that since in that area the ink ribbon 29 is held horizontally, the platen 23 and head 24 may be adjusted thereto and placed in the horizontal position. The carriage 25 is supported at a predetermined position of the feed roller 27.

With the above-described arrangement, the ink ribbon 29 is preset at a position indicated by phantom outlines in FIG. 1. When paper is inserted, the carriage 25 is driven so that the head 24 is moved apart from the surface of the platen 23. Under this condition, the paper 2 is fed by hand and inserted with the print side up on the paper guide 20 from the right side in FIG. 1. The inserted paper 2 enters the paper guide 20 and passes through the platen 23, after which the paper arrives directly below the feed roller 27. Upon confirmation that the end of the paper 2 is held by the paper pressing spring 26, the feed roller 27 is rotated clockwise and the end of the paper is exposed beyond the pressing point of the spring 26. Then, the carriage 25 is driven so that the head 24 is brought into contact with the surface of the paper 2. Under this condition, the heat-generating resisting member of the head 24 is driven according to the printing information whereby ink of the ink ribbon 29 is selectively transferred to the paper 2 for printing.

As will be apparent from the foregoing, according to the present invention, the paper feed path is formed horizontally on the whole including the printing position and the head 24 is adjusted thereto and placed in horizontal during printing. Therefore, printing can be made without turning the paper 2. Furthermore, the horizontal provision of the head 24 enables the lowering of the overall height of the apparatus and the decrease in thickness thereof.

What is claimed is:

1. In a printer having a housing provided with paper input side, a paper exit side, and printer components arranged in said housing including a ribbon cassette having an ink ribbon wound on reels therein, a translatable carriage, a printing head mounted on the carriage for printing by transferring ink from the ink ribbon onto a paper, means for moving the ink ribbon in front of the printing head from and to the ink ribbon cassette, and means including a feed roller for feeding paper from the paper input side, past the printing head, and out the paper exit side, the improvement comprising:

said housing having a body portion containing all of said printer components on one side thereof, and a bottom paper guide plate facing said body portion which is substantially planar extending from said paper input side to said paper exit side;

said body portion having said printing components arranged therein such that respective paper contacting surfaces of said printing head, ink ribbon, and feed roller are substantially in one plane facing said bottom paper guide plate, and such that said feed roller is located downstream in a paper feeding direction from said printing head toward said paper exit side, said ink ribbon cassette having a longitudinal side is parallel with said one plane of said paper contacting surfaces, and said bottom plate having provided thereon a flat paper-pressing spring member located opposite the paper contacting surface of said feed roller and a flat platen located opposite the paper contacting surfaces of said ink ribbon and printing head, whereby said printer can be formed with a thin shape and paper can be fed into said printer, printed on, and fed out of said printer along a substantially planar path.

2. A printer according to claim 1, wherein said ink ribbon cassette is disposed in said body portion upstream of said printing head relative to the paper feeding direction said ink ribbon being wound on said reels in said cassette with its width oriented perpendicular to said one plane, and further comprising means formed on one side of said cassette for turning said ink ribbon and providing it in front of said printing head such that its width is oriented coplanar with said one plane of said printing head and said platen and for turning it back for return to said cassette with its width again oriented perpendicular to said one plane.

3. A printer according to claim 2, wherein said means for turning said ink ribbon include a pair of inclined guide rollers each having associated reversing rollers for receiving, turning, and returning said ink ribbon from and to said reels of said cassette, one guide roller and associated reversing rollers being spaced apart from the other guide roller and associated reversing rollers so as to provide a length of ribbon in the space therebetween over which said printing head is translated on said carriage during printing.

* * * * *